United States Patent [19]

Taquoi

[11] 4,421,243

[45] Dec. 20, 1983

[54] CONTAINER, PARTICULARLY FOR MATERIALS IN PARTICLES

[75] Inventor: Jean-Pierre Taquoi, Soissons, France

[73] Assignee: B S L (Bignier Schmid-Laurent), Ivry s. Seine, France

[21] Appl. No.: 374,914

[22] Filed: May 4, 1982

Related U.S. Application Data

[63] Continuation of Ser. No. 153,139, May 27, 1980, abandoned.

[30] Foreign Application Priority Data

May 29, 1979 [FR] France ..... 79 13603

[51] Int. Cl.[3] ..... B65D 88/06; B65D 88/12; B65D 90/12

[52] U.S. Cl. ..... 220/1.5; 220/1 B; 220/18.1; 220/5 A; 220/71

[58] Field of Search ..... 248/146; 220/71, 5 A, 220/1.5, 1 B, 23.4, 66, 401, 70.1, 18.1

[56] References Cited

U.S. PATENT DOCUMENTS

| | | | |
|---|---|---|---|
| 2,477,831 | 8/1949 | Schmitz, Jr. | 220/1 B |
| 3,047,190 | 7/1962 | Bayer | 220/71 |
| 3,200,998 | 8/1965 | Mahar | 220/66 X |
| 3,306,489 | 2/1967 | Armbruster | 220/71 |
| 3,476,260 | 11/1969 | Jay | 206/503 |
| 3,650,501 | 3/1972 | Streb | 248/146 |
| 3,688,940 | 9/1972 | Knight et al. | 220/71 X |
| 3,726,431 | 4/1973 | Botkin | 220/18.1 |
| 3,971,491 | 7/1976 | Mowatt-Larssen et al. | 220/1.5 X |
| 4,065,022 | 12/1977 | Cainand | 220/71 |

*Primary Examiner*—Allan N. Shoap
*Attorney, Agent, or Firm*—Michael Klotz

[57] ABSTRACT

A container defined by a cylindrical metallic vessel extending between and supported by two spaced apart metallic frames with adjoining ribs secured to adjacent sides of each frame, characterized in that the edge of the side wall of the vessel is in direct longitudinal abutment against the frames and ribs.

1 Claim, 3 Drawing Figures

CONTAINER, PARTICULARLY FOR MATERIALS IN PARTICLES

This is a continuation, of application Ser. No. 153,139, filed May 27, 1980, now abandoned.

The invention relates to a container, that is a metallic vessel extending between two metallic frames, supported by the said frames, and welded thereto, said vessel being defined by a cylindrical side wall and end walls welded to the side wall.

Such container is a self-supporting and rigid unit, for transport of materials by road, rail and sea, and for storage.

The frames generally are square frames and the container may be put side to side or piled up.

Containers are described for example in French Pat. No. 69 11562 published under No. 2 040 833.

The strength of the containers depends particularly on the connections between the vessel and the supports.

In the above mentioned patent there are disclosed embodiments designed for containing liquids and liquefied gases and withstanding the pressure thereof. Containers according to this prior Patent are not basically designed for supporting materials in powder form I have sought to define a container which is particularly suitable for this application, taking into account the fact that the pressure conditions are not the same has in the case of liquids.

According to the invention, the container is characterized in that the cylindrical side wall of the vessel is, at one end or at both ends, in abutment against the supporting frame in the longitudinal direction.

This arrangement allows a considerable simplification of the support which may be constituted at one end or at both ends by a simple frame in abutment against the end edge of the cylindrical side wall of the vessel. Both frames are linked by the cylindrical wall of the vessel which is self-supporting.

In a preferred embodiment, the frame is reinforced by ribs against which the end edge of the cylindrical side wall is also in abutment.

The invention will be more readily understood on reading the following description with reference to the accompanying drawings, in which.

Figure 1:
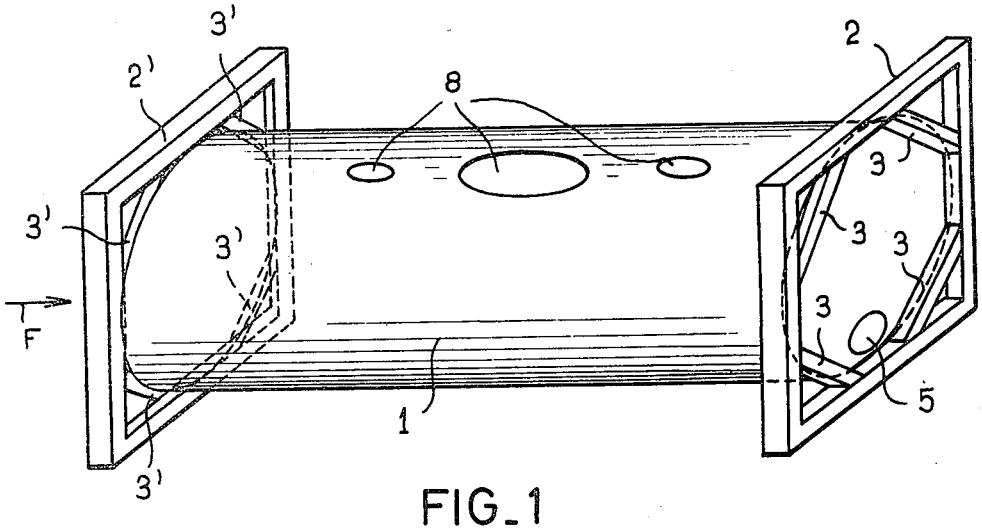
FIG. 1 is a schematic view of the container in perspective.
Figure 2:
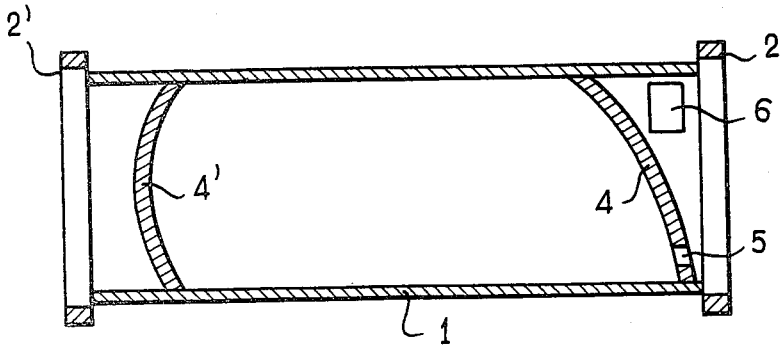
FIG. 2 is a longitudinal section through the container.
Figure 3:
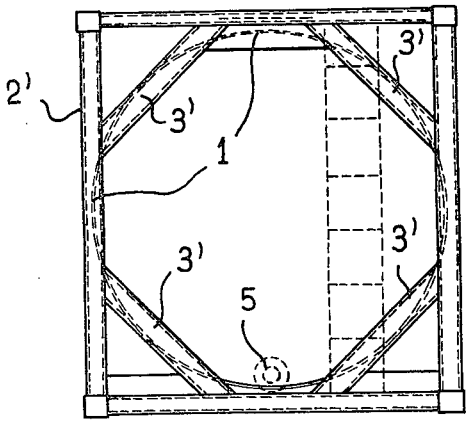
FIG. 3 is a side view of the container in the direction of F in FIG 1.

Referring now to the drawings, the container is a unit made of a cylindrical vessel joined to a pair of vertical square frames, the cylindrical side wall 1 of the vessel being horizontal and in abutment against the square frame at each end and welded thereto. The sides of the frame are connected by ribs which cooperate with the sides of the frame to constitute all or part of a polygon of contact between the frame end the contiguous and edge of the wall 1.

In the Figures, the two frames have been referenced 2 and 2' and the ribs have been referenced 3 and 3', respectively.

The vessel is defined by the lateral wall 1 and by end walls 4 and 4' which are recessed within the wall 1 and welded peripherally with respect to the wall 1. The positions of the end walls 4 and 4' are chosen as desired to define the capacity of the vessel.

One of the end walls 4 is provided with a low orifice 5 for draining the vessel and this end wall is inclined to facilitate draining of the product when the container is tipped.

A discharging unit 6 is preferably disposed in the space between the inclined end wall and the frame 2 adjacent thereto.

If desired, reinforcing pieces may connect the sides of the cylinder to the frames.

The other accessories possibly provided, for example manholes and holes for filling, have not been described in detail. These holes have simply been shown schematically at 8 in FIG. 1.

The container is useful for transporting and storing materials in particles and in powder form, such as polyethylene granulates, polypropylene granulates, chemical fertilizers and the like.

What I claimed is:

1. A self-supporting container unit comprising a cylindrical metallic vessel extending between two spaced apart metallic frames, each of said frames having four sides in rectangular configuration, adjacent sides of the frames being connected by ribs with each of the ribs at respective ends thereof being secured to two corresponding said adjacent sides, said vessel being supported by said frames and ribs and being welded to said frames and ribs at the respective end edges of the vessel, said vessel being defined by a cylindrical side wall and end walls welded to the interior side wall and spaced from said end edges, characterized in that the end edges of the side wall are in direct longitudinal abutment against said frames and ribs.

* * * * *

UNITED STATES PATENT OFFICE

CERTIFICATE OF CORRECTION

Patent No. 4,421,243 Dated December 20, 1983

Inventor(s) Jean-Pierre Taquoi

It is certified that error appears in the above-identified patent and that said Letters Patent are hereby corrected as shown below:

Column 1, line 26, after "form" add --and--

Column 1, line 29, delete "has" and substitute --as--

Signed and Sealed this

Seventeenth Day of December 1985

[SEAL]

Attest:

DONALD J. QUIGG

Attesting Officer

Commissioner of Patents and Trademarks